US011014120B2

(12) United States Patent
Pisco

(10) Patent No.: US 11,014,120 B2
(45) Date of Patent: May 25, 2021

(54) PAINT ROLLER PRESSURE ADJUSTING DEVICE

(71) Applicant: David Pisco, Elk Grove, CA (US)

(72) Inventor: David Pisco, Elk Grove, CA (US)

( * ) Notice: Subject to any disclaimer, the term of this patent is extended or adjusted under 35 U.S.C. 154(b) by 63 days.

(21) Appl. No.: 16/148,180

(22) Filed: Oct. 1, 2018

(65) Prior Publication Data

US 2020/0101489 A1 Apr. 2, 2020

(51) Int. Cl.
*B05C 17/02* (2006.01)

(52) U.S. Cl.
CPC ..... *B05C 17/022* (2013.01)

(58) Field of Classification Search
CPC ..... B05C 17/00; B05C 17/02; B05C 17/022
See application file for complete search history.

(56) References Cited

U.S. PATENT DOCUMENTS 3,866,257 A * 2/1975 Cansdale, Sr. ..... B05C 17/0205 15/230.11
5,123,768 A * 6/1992 Franklin ..... A46B 5/0075 403/84
5,207,755 A * 5/1993 Ampian ..... A46B 5/0075 15/144.1
2012/0163903 A1* 6/2012 Williams ..... B05C 17/022 403/104
2018/0126411 A1* 5/2018 Cogswell ..... B05C 17/022

* cited by examiner

*Primary Examiner* — Weilun Lo

(74) *Attorney, Agent, or Firm* — The Iwashko Law Firm, PLLC; Lev Ivan Gabriel Iwashko

(57) ABSTRACT

A paint roller pressure adjusting device to connect to a pole at a first end and a paint roller at a second end, the paint roller pressure adjusting device including a pressure adjusting portion, including a base disposed at a first end of the pressure adjusting portion, a top portion disposed at a second end of the pressure adjusting portion, the top portion having a threaded paint roller connecting portion disposed at a top surface of the top portion to connect to the paint roller, and a spring disposed between the base and the top portion, and a regulating portion, including a main body to be inserted into through the base and the spring of the pressure adjusting portion, and a threaded portion to correspond to the spring such that the main body screws into the spring.

3 Claims, 1 Drawing Sheet

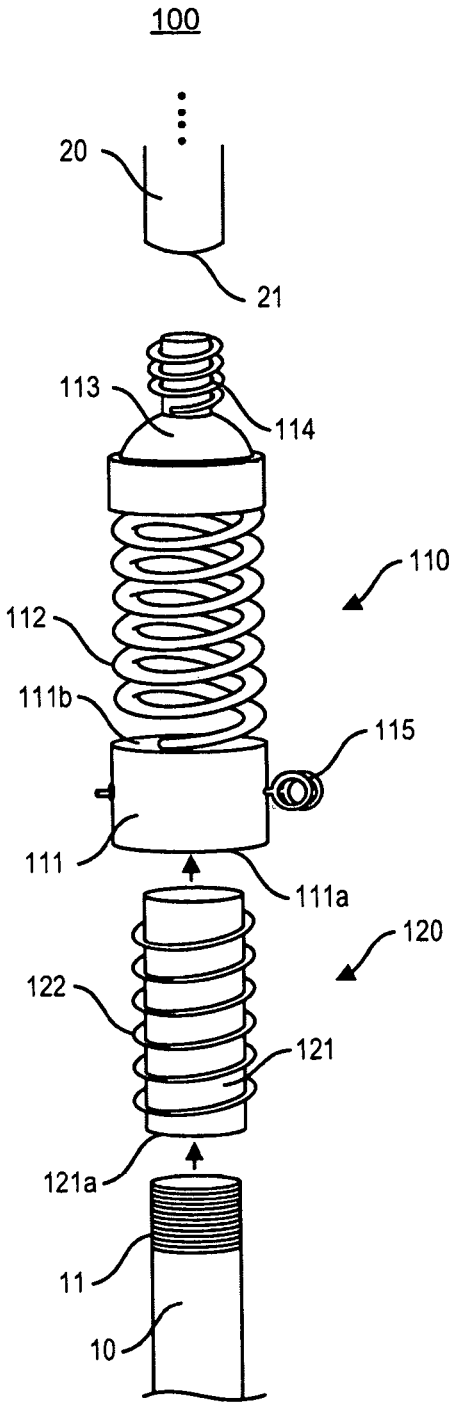
100
20
21
113
114
110
112
111b
115
111
111a
120
122
121
121a
11
10

PAINT ROLLER PRESSURE ADJUSTING DEVICE

BACKGROUND

1. Field

The present general inventive concept relates generally to a painting device, and particularly, to a paint roller pressure adjusting device.

2. Description of the Related Art

Painting can seem like an easy task for the average person in possession of a gallon of paint and a paint brush and/or roller. Unfortunately, while painting itself may be easy, getting great results is not, and those who head into a painting project without the proper tools often find themselves with walls and ceilings that are streaky, peeling, and uneven.

Therefore, there is a need for a device that facilitates painting.

SUMMARY

The present general inventive concept provides a paint roller pressure adjusting device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a paint roller pressure adjusting device to connect to a pole at a first end and a paint roller at a second end, the paint roller pressure adjusting device including a pressure adjusting portion, including a base disposed at a first end of the pressure adjusting portion, a top portion disposed at a second end of the pressure adjusting portion, the top portion having a threaded paint roller connecting portion disposed at a top surface of the top portion to connect to the paint roller, and a spring disposed between the base and the top portion, and a regulating portion, including a main body to be inserted into through the base and the spring of the pressure adjusting portion, and a threaded portion to correspond to the spring such that the main body screws into the spring.

The paint roller pressure adjusting device may further include at least one clamp to be inserted into a side portion of the base of the pressure adjusting portion to prevent the regulating portion from moving.

The regulating portion may decrease an elasticity of the spring in response to the regulating portion being inserted further within the spring.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a front angled perspective view of a paint roller pressure adjusting device, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the FIGURES, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

FIG. 1 illustrates a front angled perspective view of a paint roller pressure adjusting device 100, according to an exemplary embodiment of the present general inventive concept.

The paint roller pressure adjusting device 100 may be connected to a pole 10 at a first end and a paint roller 20 at a second end.

The paint roller pressure adjusting device 100 may include a pressure adjusting portion 110 and a regulating portion 120, but are not limited thereto.

The pressure adjusting portion 110 may include a base 111, a spring 112, a top portion 113, a paint roller connecting portion 114, and at least one adjusting clamp 115, but is not limited thereto.

A bottom portion of the base 111 of the pressure adjusting portion 110 may include a first aperture 111*a* at a first end thereof and a second aperture 111*b* at a second end thereof.

The spring 112 may extend away from the second end of the base 111 at a first end of the spring 112, such that a second end of the spring 112 is connected to the top portion 113.

The paint roller connecting portion 114 may be disposed at a top end of the top portion 113, and may be threaded on an outer surface thereof to be inserted (i.e., screwed into) into a threaded aperture 21 of the paint roller 20.

The regulating portion 120 may include a main body 121 and a threaded portion 122, but is not limited thereto.

A bottom portion of the main body 121 of the regulating portion 120 may include a threaded inner aperture 121*a*, which may receive a threaded outer surface 11 of the pole 10. The pole 10 may be an extended painter's pole, or any other pole known to one of ordinary skill in the art.

The regulating portion 120 may be inserted into the base 111 through the first aperture 111*a* and then through the second aperture 111*b*, such that the threaded portion 122 of the regulating portion 120 is screwed within the spring 112. The at least one clamp 115 may be inserted into a side portion of the base in order to contact a side portion of the main body 121, in order to prevent the regulating portion 120 from moving further into the spring 112. Specifically, the at least one clamp 115 may be screwed into a side portion of the base in order to contact the side portion of the main body 121.

The farther that the regulating portion 120 is inserted (i.e., screwed) into the spring 112, the more tension the paint roller pressure adjusting device 100 provides during painting. In other words, the spring 112 allows the paint roller 20 to elastically move while the user is painting, and the regulating portion 120 may alter an amount that the spring 112 is able to move (i.e., may alter the spring's elasticity) based on an amount that the regulating portion 120 is inserted within the spring 112. As such, when the regulating portion 120 is fully inserted within the spring 112, the spring 112 has no elasticity. Likewise, when the regulating portion 120 is not inserted within the spring 112, the spring 112 has full elasticity.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A paint roller pressure adjusting device to connect to a pole at a first end and a paint roller at a second end, the paint roller pressure adjusting device comprising:

a pressure adjusting portion, comprising:

a base disposed at a first end of the pressure adjusting portion, a top portion disposed at a second end of the pressure adjusting portion, the top portion having a threaded paint roller connecting portion disposed at a top surface of the top portion to connect to the paint roller, and a spring disposed between the base and the top portion; and a regulating portion, comprising:

a main body to be inserted into through the base and the spring of the pressure adjusting portion, and a threaded portion to correspond to the spring such that the main body screws into the spring.

2. The paint roller pressure adjusting device of claim 1, further comprising:

at least one clamp to be inserted into a side portion of the base of the pressure adjusting portion to prevent the regulating portion from moving.

3. The paint roller pressure adjusting device of claim 1, wherein the regulating portion decreases an elasticity of the spring in response to the regulating portion being inserted further within the spring.

* * * * *